US006931808B2

(12) United States Patent
Hamar

(10) Patent No.: US 6,931,808 B2
(45) Date of Patent: Aug. 23, 2005

(54) FLOOR SYSTEM

(76) Inventor: Douglas J Hamar, 220 Willson Memorial Dr., Chassel, MI (US) 49916

( * ) Notice: Subject to any disclaimer, the term of this patent is extended or adjusted under 35 U.S.C. 154(b) by 0 days.

(21) Appl. No.: 10/119,064

(22) Filed: Apr. 9, 2002

(65) Prior Publication Data

US 2002/0108341 A1 Aug. 15, 2002

Related U.S. Application Data

(63) Continuation of application No. 09/471,697, filed on Dec. 23, 1999, now Pat. No. 6,397,543, which is a continuation of application No. 08/912,040, filed on Aug. 15, 1997, now Pat. No. 6,044,606.

(60) Provisional application No. 60/024,151, filed on Aug. 15, 1996.

(51) Int. Cl.[7] ..... E04F 15/22

(52) U.S. Cl. ..... 52/403.1; 52/393; 52/480; 52/396.04; 52/508

(58) Field of Search ..... 52/393, 403.1, 52/480, 508, 396.04

(56) References Cited

U.S. PATENT DOCUMENTS 4,856,250 A * 8/1989 Gronau et al. ..... 52/480
4,879,857 A * 11/1989 Peterson et al. ..... 52/403
4,890,434 A * 1/1990 Niese ..... 52/393
5,016,413 A * 5/1991 Couniham ..... 52/391
5,277,010 A * 1/1994 Stephenson et al. ..... 52/403
5,303,526 A * 4/1994 Niese ..... 52/393
5,369,927 A * 12/1994 Couniham ..... 52/403
5,377,471 A * 1/1995 Niese ..... 52/482
5,388,380 A * 2/1995 Niese ..... 52/480
5,412,917 A * 5/1995 Shelton ..... 52/403.1
5,433,052 A * 7/1995 Niese ..... 52/403.1
5,465,548 A * 11/1995 Niese ..... 52/741.1
5,566,930 A * 10/1996 Niese ..... 267/153
5,609,000 A * 3/1997 Niese ..... 52/480
5,682,724 A * 11/1997 Randjelovic ..... 52/403.1
6,044,606 A * 4/2000 Hamar ..... 52/403.1
6,397,543 B1 * 6/2002 Hamar ..... 52/403.1

* cited by examiner

*Primary Examiner*—Carl D. Friedman
*Assistant Examiner*—Yvonne M. Horton
(74) *Attorney, Agent, or Firm*—Warn Hoffmann Miller & LaLone PC

(57) ABSTRACT

A floor system composed of a finished flooring preferably secured to a subfloor, a plurality of shock absorber members are fixed to the bottom surface of the floor surface at spaced intervals and in which each of the shock absorber members includes an elastomeric base member provided with a cavity which accommodates an insert member for adjusting the cushioning ability of the base member.

10 Claims, 5 Drawing Sheets

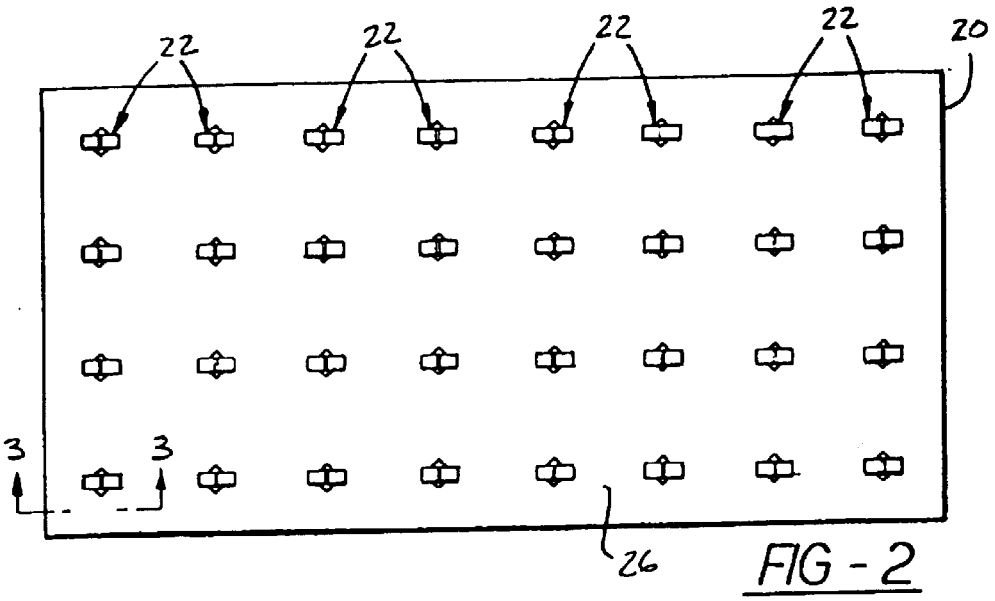
FIG - 2
FIG - 3
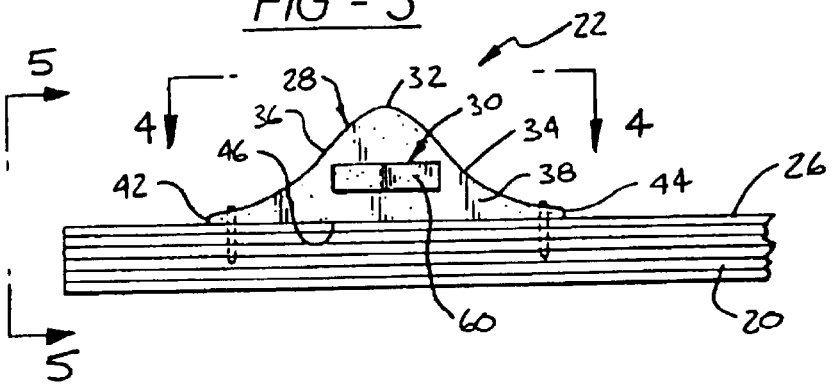
FIG - 4
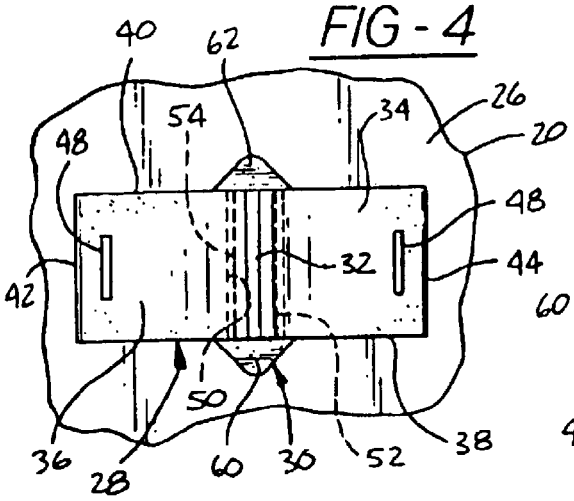
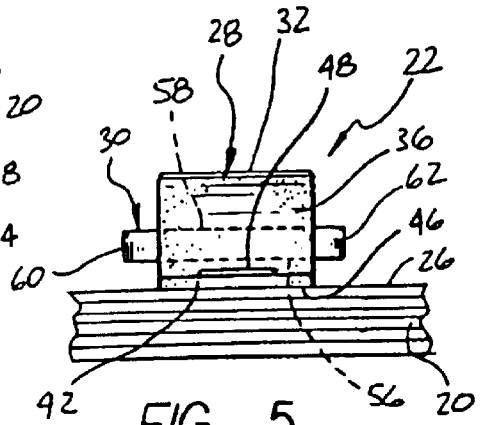
FIG - 5

FLOOR SYSTEM

CROSS-REFERENCE TO RELATED APPLICATIONS

The application is a continuation of U.S. Ser. No. 09/471,697 titled FLOOR SYSTEM filed Dec. 23, 1999 now U.S. Pat. 6,397,543 which is a continuation of U.S. Ser. No. 08/912,040 filed Aug. 15, 1997 now U.S. Pat. No. 6,044,606 titled FLOOR SYSTEM issued Apr. 4, 2000 which claims benefit of U.S. Ser. No. 60/024,151 titled FLOOR SYSTEM filed Aug. 15, 1996.

TECHNICAL FIELD

This invention concerns floor systems and more particularly relates to a floor system that has a customized performance of resiliency for a specified activity.

BACKGROUND OF THE INVENTION

There have been various types of floor systems provided in the past which have employed some form of cushioning for absorbing shock. One form of floor system that has been offered by the assignee of this invention is the so called "Thrust-A-Cushion Panel System". This sports floor system provides a shock-absorbing, fatigue-reducing flooring system ideal for active sports applications. The construction of this type of flooring system is of a type which has the finished flooring and the subfloor sections supported at spaced intervals by generally rectangular elastomeric pads integrally formed with a plurality of parallel rib.

Another form of floor system that has been offered by the assignee of this invention is the so called "Vari-Cushion System". This type of flooring system is a specially designed cushioned sports flooring system which has the finished hardwood flooring and the subfloor sections supported at spaced interval by the same type of elastomeric pads used in the above-described "Thrust-A-Cushion Panel System". In addition, the pads rest on a continuous layer of ¼ inch thick crosslinked closed cell polyethylene foam so as to provide two distinct levels of shock absorption. This floor system provides a smooth transition from Stage I (foam compression) through State II (pad compression). In other words, light loads on the flooring only compress the closed cell polyethylene foam whereas heavier loads compress both the foam and the pads. The transfer of forces on the flooring takes place smoothly and energy is returned to the participant in an efficient manner.

Others have also proposed various forms of floor systems having shock absorbing capabilities. For example, in U.S. Pat. No. 4,890,434 in the name of Michael W. Niese and issued on Jan. 2, 1990, a hardwood floor system is disclosed which has the subfloor sections provided with criss-cross kerf patterns formed in one of the surfaces of each subfloor section. In addition, this floor system has a plurality of elastomeric pads secured to the bottom surface of the lower floor sections to support the floor system in a free floating manner above a base such as a concrete slab. The upper portion of each pad has oppositely extending tabs for securing to the bottom surface of the lower subfloor.

Another form of floor system employing shock absorbing capabilities that has been proposed by others can be seen in U.S. Pat. No. 4,879,857 in the name of Peterson et al. and issued on Nov. 14, 1989. In this particular floor system the finished flooring is mounted on a subfloor which, in turn, is supported over a solid base such as a cement slab. In addition, a number of spaced apart individual nodule-like resilient shock absorbing members are located under the subflooring and serve to support the subflooring and the playing surface on the solid base. Each of the shock absorbing members is molded as a single homogeneous unit made of a polyurethane material having the same durometer throughout. Alternatively, the shock absorbing member may have one portion made of a material having one durometer and another portion made of the same or different material having a different durometer.

Other U.S. patents showing floor systems incorporating shock absorbing capabilities are as follows:

U.S. Pat. No. 5,303,526, Niese, issued Apr. 19, 1994

U.S. Pat. No. 5,377,471, Niese, issued Jan. 3, 1995

U.S. Pat. No. 5,388,380, Niese, issued Feb. 14, 1995

U.S. Pat. No. 5,433,052, Niese, issued Jul. 18, 1995

U.S. Pat. No. 5,465,548, Niese, issued Nov. 14, 1995

SUMMARY OF THE INVENTION

The present invention is similar to the above-described floor systems in that it also utilizes shock absorber members or pads for cushioning the foot impact of individuals using the flooring. However, it differs from the above-described floor systems in that it utilizes shock absorber members which can be fine tuned for specific activities such as dancing, gymnastics, aerobics, and basketball. This is accomplished by having a shock absorber member which includes two separate parts that are combined and interconnected to form a single cushioning member. By varying the cushioning ability of the shock absorber member, one can tailor the dance, gymnastic, and basketball practice area of the flooring system to have a relatively soft (low durometer) cushioning arrangement whereas the competitive area has a harder (higher durometer) cushioning arrangement while utilizing the same subfloor structure throughout the extent of the floor system. Thus, by use of the present invention, customization of a specific installation is achievable to provide different shock absorption levels within the same floor to accommodate different functions.

More specifically, each of the shock absorber members which forms a part of the present invention includes a base member and an insert member. Both the base member and the insert member are preferably made of an elastomeric material such as polyvinyl chloride of a pre-selected hardness. Of course, any other suitable material may be used within the context of the present invention. The base member can be made using an extrusion process after which it is cut into individual similarly sized parts. In cross-section, the base member has a pyramidal configuration with the outer end portions serving as mounting arms which can be fastened to the subfloor of the sports floor system by fasteners such as staples. A rectangular opening or cavity is centrally formed in the main body portion of the base member for accommodating the insert member. The insert member can also be made using an extrusion process and takes the form of an elongated bar which is rectangular in cross section. The opposed ends of the bar section of the insert member are arrow shaped with flexible barbs which allow the arrow end of the insert member to be inserted into the accommodating rectangular opening formed in the base member and be retained therein. By making the base member and the insert member of elastomeric material having different durometers, one can select the combination that will provide the desired shock absorption characteristics at various locations of the sports floor system.

The present invention also contemplates the use of the above-described two-piece shock absorber member in a portable floor system as well as a permanent type floor system. One type of portable floor system with which this shock absorber member can be used is disclosed in commonly assigned U.S. Pat. No. 4,538,392 issued on Sep. 3, 1985. In this type of floor system, the flooring is sectionalized into a plurality of floor sections arranged in rows with each section composed of inter-engaged strips of wood which define the floor surface. Spaced stringers or sleepers extend transversely of the strips of wood and an underlayment is interposed between the strips of wood and the stringers. During installation of the portable floor system, the floor sections are interconnected at adjacent corners and pivoted into interlocking positions. In this instance, it is intended that the two-piece shock absorber member be attached at spaced intervals to the stringers of each of the floor sections. As should be apparent, pivoting of the floor sections having the two-piece shock absorber members attached to the stringers could result in damage to the shock absorber members and increase the force necessary to interconnect one floor section to another particularly when the floor sections are installed on a concrete slab. Therefore, in this instance, a U-shaped plastic guard member is provided which encloses or encapsulates the shock absorber members and prevents damage to the latter members while facilitating the movement of the sectionalized floor sections during installation of the portable floor system.

Accordingly, an object of the present invention is to provide a new and improved floor system in which various locations of the flooring system is provided with two-piece shock absorber members which members are interchangeable for providing a customized performance level of resiliency for a specified activity.

Another object of the present invention is to provided a new and improved floor system having finished flooring provided on a subfloor which, in turn, is provided with a plurality of shock absorber members each of which can be tuned by the insertion of a connectable member to vary the cushioning ability of the shock absorber member.

A further object of the present invention is to provide a new and improved floor system in which interconnected strips of wood form a finished flooring for various activities with the flooring being fastened to a subfloor attached to which are a plurality of spaced shock absorber members each of which includes an elastomeric base member adapted to be combined with another elastomeric member to provide a cushioning effect of a magnitude less than provided by the base member alone.

A still further object of the present invention is to provide a new and improved floor system including an upper floor surface and a bottom surface which has a plurality of shock absorber members fixed to the bottom surface of the floor system at spaced intervals and in which each of the shock absorber members includes an elastomeric base member provided with a cavity which accommodates an insert member for decreasing the cushioning ability of the base member.

A still further object of the present invention is to provide a new and improved floor system having a finished flooring fixed to a subfloor the bottom surface of which has a plurality of shock absorber members attached thereto with each of the shock absorber members being characterized in that it is formed as two separate members each made of an elastomeric material having either the same or a different durometer and which can be combined into a single unit so as to provide a desired performance effect.

A still further object of the present invention is to provide a new and improved portable floor system having individual floor sections which include a finished flooring of separate interconnected strips of wood fastened to a subfloor which, in turn, is secured to transversely extending stringer members provided with individual elastomeric shock absorber members encapsulated within a guard member which protects the shock absorber members from being damaged during the installation of the floor sections.

A still further object of the present invention is to provide a new and improved portable floor system composed of a plurality of floor sections which include a finished flooring of interconnected strips of wood fastened to a subfloor attached to transverse stringer members provided with elastomeric shock absorber members spaced along the length of each of the stringer members and in which a trough like plastic guard member is secured to each of the stringer members to protect the shock absorber members during installation and to facilitate the assembly of the floor sections.

A still further object of the present invention is to provide a new and improved floor system which includes a finished flooring secured to a plurality of subfloor panels having stringer members attached to the bottom surfaces of the subfloor panels and in which each of the stringer members is provided with a plurality of spaced shock absorber members enclosed within an elongated U-shaped plastic guard member of uniform cross section that extends the length of the stringer member.

Other objects, features, and advantages of the present invention will be apparent from the following detailed description when taken with the drawings in which:

BRIEF DESCRIPTION OF THE DRAWINGS

FIG. 2 is a plan view of one of the lower subfloor panels which form a part of the floor system of FIG. 1;

FIG. 3 is an enlarged sectional view taken on line 3—3 of FIG. 2 and shows one of the plurality of shock absorber members which form a part of the floor system of FIG. 1;

FIG. 4 is a view of the shock absorber member taken along line 4—4 of FIG. 3.

FIG. 5 is a view of the shock absorber member taken along line 5—5 of FIG. 4;

DETAILED DESCRIPTION OF THE PREFERRED EMBODIMENTS

Figure 1:
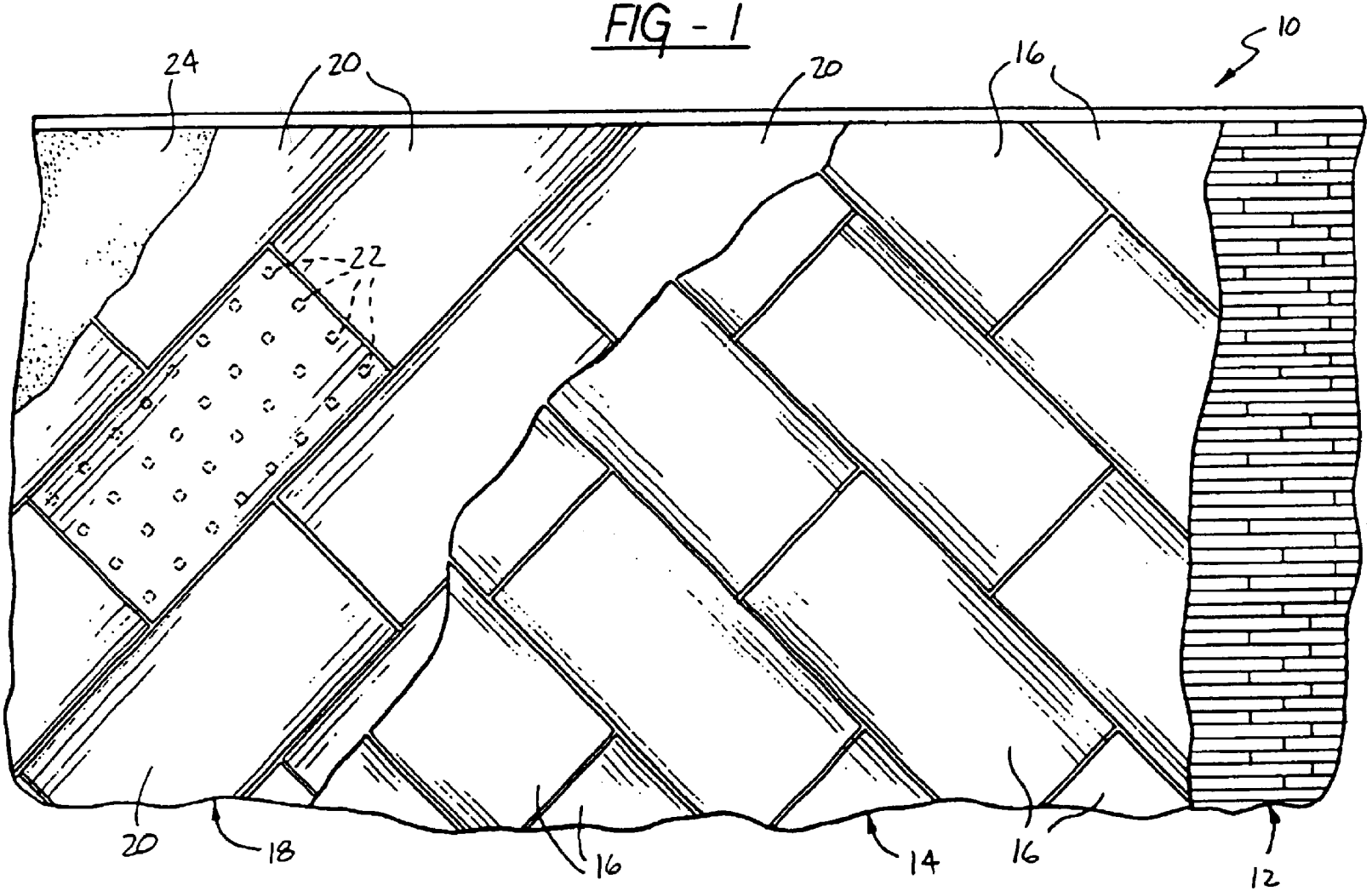
FIG. 1 is a broken-away plan view of a floor system intended for permanent use and which is made in accordance with the present invention.

Referring to the drawings and more particularly FIG. 1 thereof, a broken-away plan view of a floor system 10 is shown made in accordance with the present invention. The floor system 10 is intended to be a permanent installation and, for illustration purposes, is intended to serve as a basketball court. As will be apparent as the description of the invention proceeds, the present invention can also take the form of a portable type floor system which consists of a plurality of individual floor sections designed to be easily and quickly installed over a concrete, synthetic or appropriately insulated ice arena base.

In the preferred form, the floor system 10 seen in FIG. 1 consists of a finished flooring 12, an upper subfloor layer 14 consisting of a plurality of approximately 4'×8' panels or sheets 16 of plywood or similar underlayment material, such as, for example, oriented strandboard, a lower subfloor layer 18 consisting of a plurality of similarly dimensioned sheets or panels 20 of plywood or other suitable material, the bottom support structure engaging surfaces of which are provided with shock absorber members 22, and a sheet 24 of six mil polyethylene material all of which rest on a base such as a concrete slab.

The finished flooring 12 consists of tongue and groove strips of wood which can be made of a hard maple. Each strip of wood can measure approximately 25/32" or approximately 33/32" thick by approximately 2¼" or approximately 1½ wide. The strips of wood are installed parallel with the major axis of the court and are nailed to the upper and lower subfloor plywood panels 16 and 20 so as to provide the finished flooring 12. In this instance, each of the panels 20 of the lower subfloor 18 are positioned at a 45 degree angle to the length direction of the finished flooring 12 and a minimum of approximately ¼" space is left between adjoining panels 20 for expansion purposes. Each of the panels 16 of the upper subfloor layer 14 are positioned at a 90 degree angle to the panels 20 of the lower subfloor layer 18 while also leaving a minimum of approximately ¼" between adjoining panels for expansion purposes.

During installation of the floor system 10, the sheet 24 of polyethylene is initially placed on the concrete slab to completely cover the latter. Although, in most cases, several sheets of the polyethylene will be needed and a continuous vapor barrier can be provided by sealing and lapping all of the joints of the several sheets. Prior to placing the lower layer 18 of panels 20 onto the sheet of polyethylene, the bottom flat surface 26 of each of the panels 20 is provided with thirty-two shock absorbers 22 in a grid fashion at 12" intervals and 6" in from all of the perimeter edges of the panel as seen in FIG. 2. Of course, the shock absorbers may be placed in any other suitable orientation.

In this regard and as seen in FIGS. 3–6, each of the shock absorber members 22 includes two separate parts that are combined and interconnected to form a single cushioning member. More specifically, each of the shock absorber members 22 includes a base member 28 and an insert member 30. Both the base member 28 and the insert member 30 are made of an elastomeric material such a polyvinyl chloride blend of a pre-selected hardness. In addition, the base member 28 as well as the insert member 30 are each made using an extrusion process after which they are cut into individual similarly sized parts. However, it will be appreciated that any other suitable manufacturing technique falls within the scope of the present invention.

Figure 6:
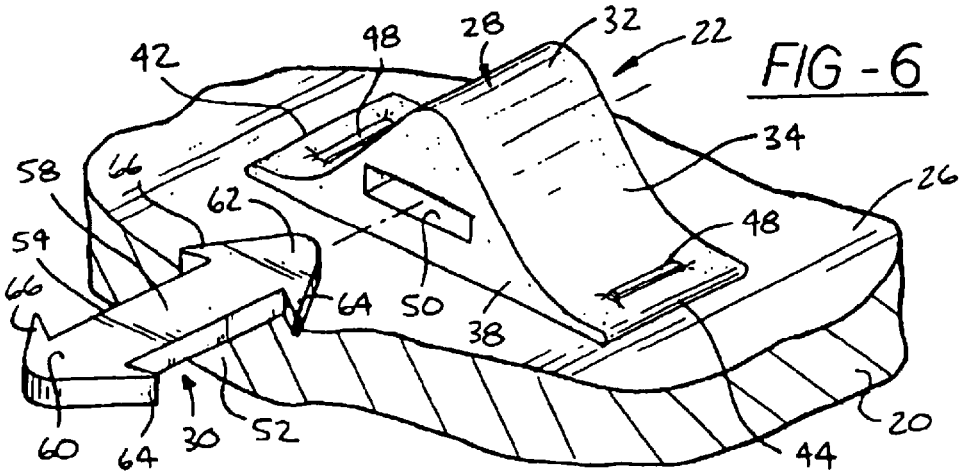
FIG. 6 is an isometric view of the shock absorber member of FIGS. 3–5 with the insert member removed from the base portion of the shock absorber member.

As best seen in FIGS. 3 and 6, the base member 28 has a pyramidal configuration defined by a slightly rounded contact surface 32 which connects with a pair of diverging surfaces 34 and 36 which, in turn, are bounded by a flat front surface 38 and a flat rear surface 40. As seen in FIG. 4, the front and rear surfaces 38 and 40 are parallel to each other while the diverging surfaces terminate at straight edges 42 and 44 respectively, which are also parallel to each other and cooperate with a bottom flat surface 46 to form a pair of tapered mounting arms which are fastened to the bottom surface 26 of each plywood panel 20 of the floor system 10 by fasteners such as staples 48. An opening or cavity 50 which is rectangular in shape is centrally formed in the main body portion of the base member 28 for accommodating the insert member 30. The opening 50 extends through the entire length of the main body portion of the base member 28 from the front surface 38 to the rear surface 40 thereof and is of a uniform cross section.

With further reference to FIGS. 3–6, the insert member 30 has its main portion taking the form of an elongated bar which is also rectangular in cross section and is defined by a pair of laterally spaced and parallel side walls 52 and 54, a bottom wall 56, and a top wall 58. The thickness dimension of the main portion between parallel walls 56 and 58 is essentially the same as the vertical dimension of the rectangular opening 50 in the base member 28. The width dimension between side walls 52 and 54 of the main portion of the insert member is less than the horizontal dimension of the opening 50 for reasons which will be explained hereinafter. Also, the main portion of the insert member 30 has a length which is substantially the same as the length of the opening 50 in the base member 28.

The opposed ends 60 and 62 of the main portion of the insert member 30 are arrow-shaped with a pair of integrally formed flexible barbs 64 and 66. The barbs 64 and 66 project laterally outwardly a distance greater than the width dimension of the opening 50 in the base member 28. Thus, during insertion of an arrow end of the insert member 30 into the opening 50 of the base member 28, the barbs 64 and 66 will be flexed inwardly towards the side walls 52 and 54 of the insert member. The insertion is facilitated by the of the fact that the width dimension of the opening is greater than the width dimension of the main portion of the insert member 30. Once the main portion of the insert member 30 is located in the opening 50 of the base member 28 as seen in FIG. 4, the flexible barbs 64 and 66 at the inserted end of the insert member 30 spring back to their normal positions and, together with the barbs 64 and 66 at the opposite end of insert member, serve to retain the insert member 30 within the opening 50. To remove an insert member 30 from the base member 28, one merely needs to manually push one arrow end 60 or the other end 62 further into the opening 50 causing the barbs 64 and 66 at the end being pushed to bend outwardly to allow the insert member 30 to be withdrawn from the opening 50.

In applying each of the shock absorber members to the bottom surface 26 of the lower panel 20, the installer will first provide a layout of the grid system as seen in FIG. 2 and, afterwards, fasten each of the base members 28 at the marked spot by stapling each of the mounting arms of the base member 28 to the panel. Depending upon the resiliency desired in the floor system 10, the base member 28 may or may not have an insert member 30 combined with the base member 28 as described above.

In this regard, it should be noted that the base member 28 and the insert member 30 are made of an elastomeric material having either the same or different durometers. Thus, by having both the base member 28 and the insert member 30 made of an elastomeric material having various hardnesses, one can select the combination that will provide the performance characteristics desired. The performance levels effected by the system include, but are not necessarily limited to, the shock absorption, ball bounce, vertical deflection, area of deflection and rolling load. For example, three base members 28 can be made of elastomeric materials having separate durometers in the range of 40–100, Shore A. Similarly, three insert members 30 can be made of elastomeric materials having durometers in the same range. By so doing, and selecting materials for each member having three durometers such as 40, 50 and 60, one can provide twelve possible combinations. In other words, one could use the three base members 28 of different durometers (40, 50 and 60) alone without the insert members 30 and have three levels of hardness. On the other hand, one could combine an insert member 30 of a particular durometer with a base member 28 of the same durometer and have another level of hardness or combine the insert member 30 of one durometer with a base member 28 of a different durometer for other levels of hardness. The base members 28 and the insert members 30 could be colored coded to represent specific levels of hardness and permit the combining of the two for the desired hardness level. It will be understood that the above description of having three levels of hardness for the base member 28 and the insert member 30 is for illustrative purposes only. Obviously, one could have more than three levels of hardness for the base member 28 and the insert member 30 and depending upon the hardnesses chosen for the base member 28 and the insert member 30, one could arrive at an infinite number of combinations. Any desired hardness for the base member 28 at an insert member 30 may, therefore, be used within the scope of the present invention.

Thus, as hereinbefore mentioned, by varying the cushioning ability of the shock absorber member 22, one can tailor the floor system 10 to have a relatively soft (low durometer) cushioning arrangement or a harder (higher durometer) cushioning arrangement. In this manner, the performance levels of the floor can be adjusted. Moreover, this floor system 10 allows the flooring to be used for different activities if desired such as dance, gymnastics, volleyball, basketball, or aerobics while utilizing the same subfloor structure throughout the extent of the floor system 10. Accordingly, it should be apparent that, by use of the present invention, customization of a specific installation is achievable to provide different performance levels within the same floor to accommodate different functions. Another advantage in having shock absorber members 22 of the configuration described above is that both the base member 28 and the insert member 30 lend themselves well to be made as an extrusion which, afterwards, each can be cut into identical separate parts. It will be appreciated that any other suitable manufacturing technique may be used within the scope of the present invention.

It will be appreciated that the height of the base member 28 will also effect the performance characteristics of the system. While any size base member can be used within the scope of the present invention, it has been found that base members 28 measuring between 7/16" and ¾" provide satisfactory results. Of course, it will be appreciated that any height base member 28 falls within the scope of the present invention.

As alluded to above, the floor system according to this invention can also take the form of a portable sectionalized flooring composed of a plurality of pivotally interconnected floor sections. A detailed description of this type of portable flooring is provided in commonly assigned U.S. Pat. No. 4,538,392 issued on Sep. 3, 1985 and reference is made to that patent for a complete understanding of the portable flooring.

Figure 7:
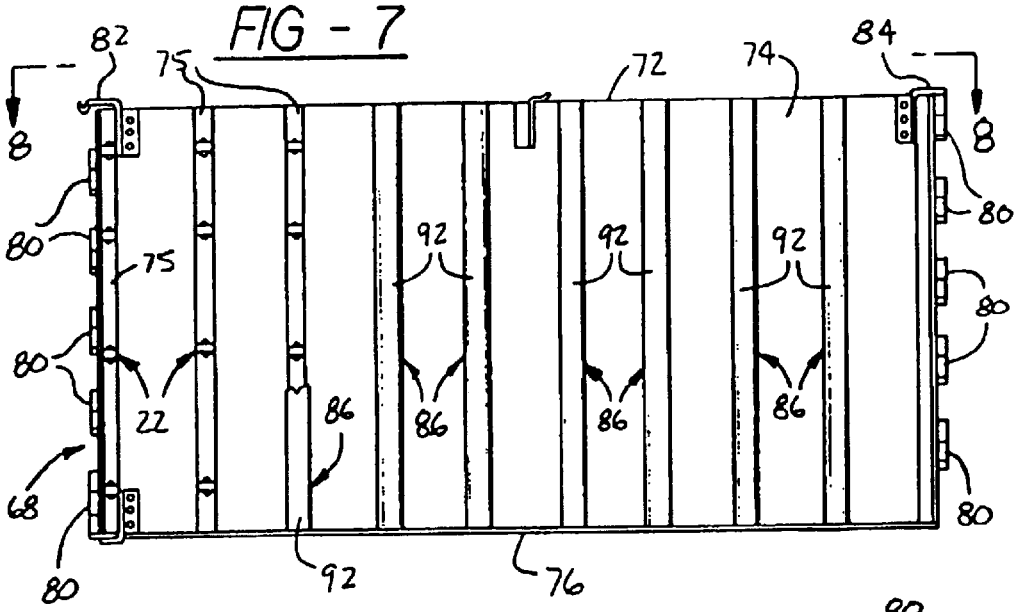
FIG. 7 is a plan view of the bottom portion of one of the floor sections of a portable floor system employing the shock absorber members seen in FIGS. 3–6 and enclosed by a guard member.
Figure 8:
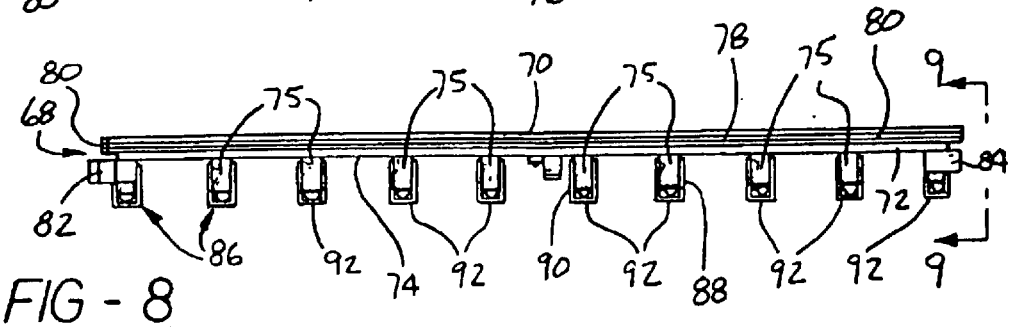
FIG. 8 is an elevational view of the floor section of FIG. 7 taken on line 8—8 of FIG. 7.
Figure 9:
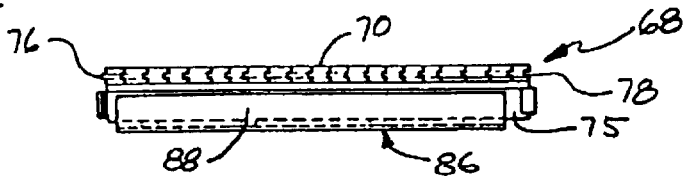
FIG. 9 is a side elevational view of the floor section of FIG. 7 taken on line 9—9 of FIG. 8.

As seen in FIGS. 7–9, one of the large floor sections of the portable floor system referred to above is illustrated and is identified generally by reference numeral 68. More particularly, FIG. 7 shows the underside of the floor section 68 while FIG. 8 shows a side elevational view of the floor section 68, and FIG. 9 shows an end view of the floor section 68. The floor section 68 is composed of interengaged tongue and groove wood flooring strips which collectively define the finished floor surface 70 of each floor section 68. The wood flooring strips are secured to a suitable subfloor panel 72 which measures approximately four feet wide by eight feet long. The bottom surface 74 of the subfloor panel 72, in turn, has a plurality of parallel and substantially identical stringers 75 secured thereto that are made of wood measuring two inches by three inches. As with the permanent floor system 10 described above, the wood strips providing the finished floor surface 70 can be hard maple of similar dimensions and collectively provide a floor section 68 with a tongue 76 extending longitudinally along one side of the panel and a groove 78 extending longitudinally along the opposite side of the panel.

One feature of the portable sectionalized flooring disclosed in the above-mentioned '392 patent resides in the floor sections having interlocking finger joints between the ends of adjoining longitudinally aligned floor sections in each row. Thus, the floor section 68, which is one of the internal sections of the portable sectionalized flooring has both ends provided with projecting fingers 80 which are defined by selected strips of the floor section projecting beyond strips which are intermediate these selected strips. As more fully explained in the '392 patent mentioned above, the projecting fingers 80 on adjoining longitudinally aligned floor sections interdigitate to form interlocking finger joints within each row of the floor sections.

The floor section 68 is also provided with latch devices which permit adjoining floor sections to interlock. Although only one part of the latches is shown employed by the floor section, it will be understood that complementary parts are provided on adjoining floor sections in each row. Thus, as seen in FIG. 7, one of the latch devices includes a hook member 82 secured to the underside 74 of the panel adjacent one corner and adapted to mate with a hook member, such as hook member 84, of an adjoining floor section. The hook members 82 and 84 of adjoining floor sections, when engaged, serve to provide a hinge about which a floor section, such as floor section 68, can be swung into hingedly interlocking relation with another floor section as more fully explained in the '392 patent mentioned above. For present purposes, it is only necessary to know that the floor section 68 is one of the many floor sections of a portable flooring and that the floor section 68 experiences a pivoting or swinging movement during installation. During this movement, each of the stringers 75 would be in contact with the supporting base (such as a concrete slab) as the floor section slides about its hinged pivot point into an interlocking position with the adjoining floor panels.

Figure 10:
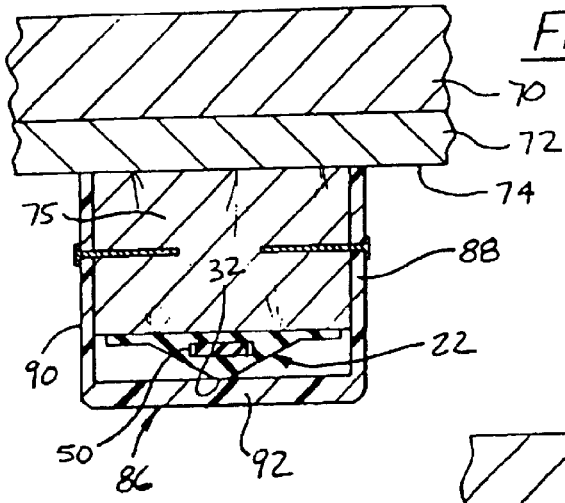
FIG. 10 is an enlarged view of one of the stringer members of FIG. 8 and shows the combination shock absorber member and the guard member in the unloaded state.
Figure 12:
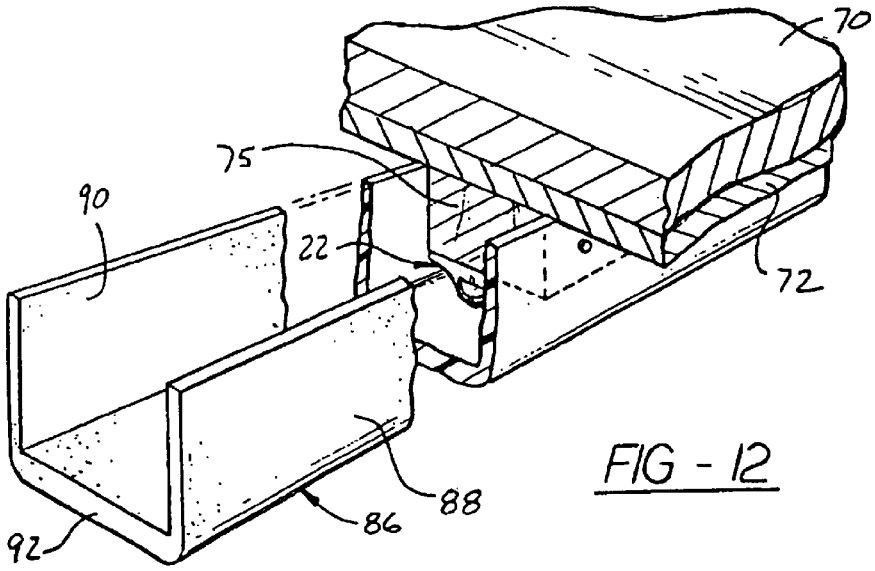
FIG. 12 is a perspective view of one of the guard members that is part of the combination seen in FIGS. 7–11.

As seen in FIGS. 7–10, it will be noted that, in this instance, the bottom support structure engaging surface of each of the stringers 75 is provided with four shock absorber members 22 of the type shown in FIGS. 2–6. As in the case of the panels used in the floor system 10 described above, each of the shock absorber members 22 is positioned at one foot intervals along the length of the associated stringer 75 with a six inch space provided at the perimeter. Also, as in the case of the floor system 10, each of the shock absorber members 22 has its opposed arms stapled to the associated stringer 75 as seen in FIG. 10. However, one major difference in this arrangement over that of the floor system 10 is that a trough-like plastic guard member 86, as seen in FIG. 12, is provided along each stringer 75 and serves to enclose or encapsulate the four shock absorber members 22 as seen in FIGS. 9 and 10. Each guard member 86 is of a length sufficient to cover all of the shock absorber members 22 provided along a stringer 75, is U-shaped in cross section, and comprises a pair of parallel sides walls 88 and 90 integrally formed with a bottom wall 92. The side walls 88 and 90 of the guard member 86 are spaced a distance approximating the width dimension of the associated stringer 75.

Figure 11:
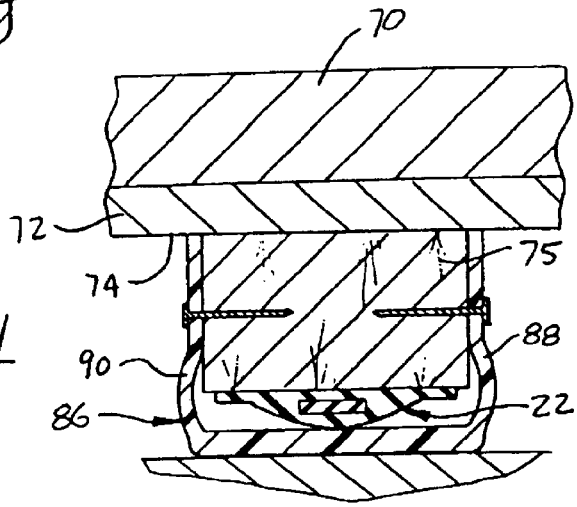
FIG. 11 is a view similar to that of FIG. 10 but shows the combination shock absorber member and the guard member under a compressive load.

As best seen in FIG. 10, each guard member 86 has its side walls 88 and 90 stapled or nailed to the opposed sides of the associated stringer 75 and has its bottom wall 92 in contact with the contact surface 32 of the shock absorbers 22 without applying any compressive forces thereto prior to installation. When the floor section 68 is installed on the support base, the side walls will tend to flex outwardly slightly and more so when under load as seen in FIG. 11. At the same time, when subjected to high loads, the main portion of the insert member 30 will be compressed and tend to fill the opening 50 of the base member 28 as seen in FIG. 11.

Figure 13:
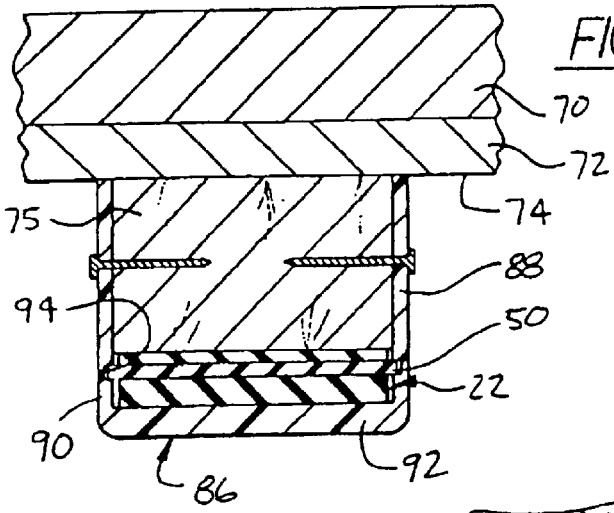
FIG. 13 is an enlarged view of one of the stringer members of FIG. 8 and showing the shock absorber member in an alternate orientation and an alternate embodiment of the guard member.
Figure 14:
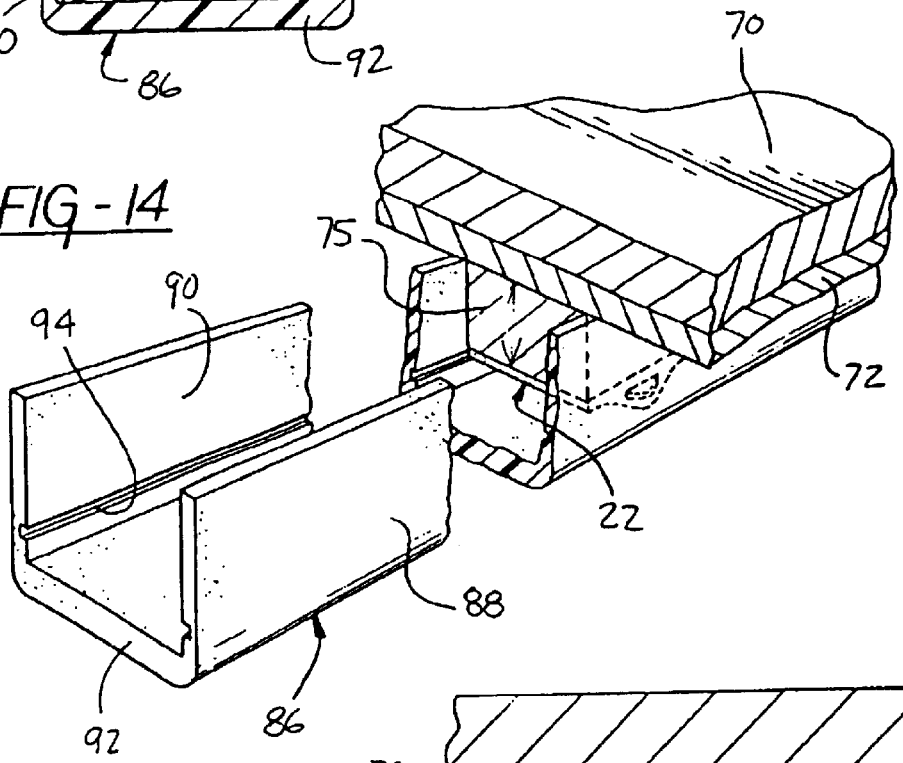
FIG. 14 is a perspective view of the alternate guard member and orientation of the shock absorber member that is part of the combination seen in FIG. 13.
Figure 15:
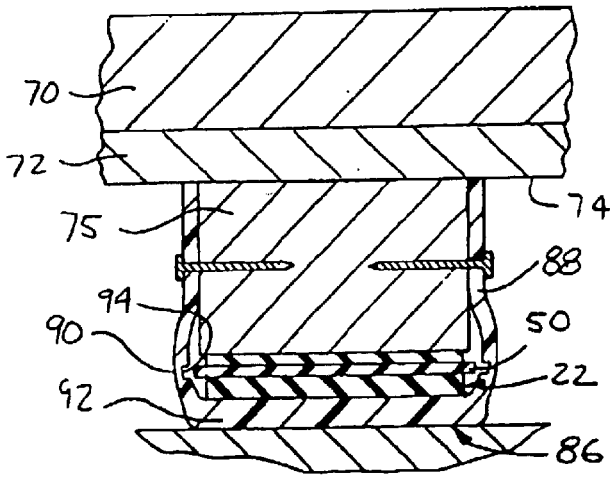
FIG. 15 is a view of the embodiment of FIG. 13 in a compressed state.

While the shock absorber member may have any orientation with respect to the stringer 75, it is preferred that the opening 50 of the base member 28 be perpendicular to the length of the stringer 75 as shown in FIGS. 13 and 14. Furthermore, the side walls 88 and 90 may have a notch 94 extending the entire length of the guard member 86. In this manner, the notch 94 can accept the pointed ends of the insert member 30 and can also provide a relief point for aiding flexing of the side walls 88 and 90. It will be appreciated, however, that the notch 94 may not be used in certain applications. If no notch is used, the width of the associated stringer must be of a dimension at least equal to or greater than the overall length of the insert member 30 so that the side walls 88 and 90 do not interfere with the cushioning characteristics of the associated shock absorber member 22.

Note that the guard member 86 serves to protect the shock absorber members 22 from damage when the floor section 68 is being swung into interlocking position with the adjoining floor sections. An important consideration is to have the side walls 88 and 90 of the guard member 86 designed so that they are flexible enough so as to not effect the cushioning ability of the shock absorber members 22 and yet have sufficient rigidity to withstand the sliding movement when a floor section 68 is swung into its operative position. One example of a guard member 86 found to provide the results desired when applied to a stringer 75 measuring approximately one and one-half inches square had a side wall thickness of approximately ⅛ inch and a bottom wall thickness of approximately ¼ inch and was made of a polyvinyl material having a durometer of 80 Shore A. It will be appreciated, however, that any suitable size stringer 75 and guard member 86 may be used within the scope of the present invention.

It will also be noted that although the floor systems described above have the shock absorber members 22 spaced twelve inches on center, the spacing can be greater or less depending upon the use to which the floor system is made and the performance desired. In addition, although the insert member 30 and the opening 50 in the base member 28 preferably are rectangular in cross section, the shape of the opening in the base member and corresponding shape of the insert member could be varied without affecting the operation of the shock absorber member. In other words, the cross section of both could be square, round, triangular or of another configuration, if desired, with sufficient clearance being provided in the opening of the base member to accommodate the arrow head end of the insert member and also allow some lateral elastomeric flow of the main portion of the insert member when the shock absorber member is under load. Also, although the finished flooring in each of the described floor systems is composed of tongue and groove strips of wood, the finished floor could take other forms such as a parquet floor of square or rectangular wood panels, carpet, vinyl composition tile, or any other floor covering material.

Accordingly, it will be understood that various changes and modifications can be made in the above described floor systems without departing from the spirit of the invention. Such changes are contemplated by the inventor and he does not wish to be limited except by the scope of the appended claims.

What is claimed is as follows:

1. A floor system having a cushion design for providing a customized performance level of resiliency for a specified activity, said floor system including:

an upper floor surface and a bottom support structure engaging surface; and a plurality of shock absorber pads secured to said bottom surface of said floor system, each of said shock absorber pads including a first elastomeric portion and a second elastomeric portion at least partially disposed within said first elastomeric portion wherein the durometer of said first elastomeric portion differs from the durometer of said second elastomeric portion.

2. The floor system of claim 1 wherein the durometer of said first elastomeric portion is in the range of 40–100, Shore A.

3. The floor system of claim 1 wherein the durometer of said second elastomeric portion is in the range of 40–100, Shore A.

4. The floor system of claim 3 wherein said first elastomeric portion has a pyramidal configuration with a pair of integrally formed opposed arms for fastening said first elastomeric portion to said bottom surface.

5. The floor system of claim 3 wherein said bottom surface includes a subfloor and said shock absorber pads are secured to said subfloor.

6. The floor system of claim 3 wherein said bottom surface includes a plurality of stringers and said shock absorber pads are secured to said stringers.

7. A shock absorber pad adapted to be fastened to the underside of a floor system including an upper floor surface for providing a customized performance level of resiliency for a specified activity on the upper floor surface of said floor system, said shock absorber pad including a first elastomeric portion and a second elastomeric portion at least partially disposed within said first elastomeric portion wherein the durometer of said first elastomeric portion differs from the durometer of said second elastomeric portion.

8. The shock absorber pad of claim 7 wherein the durometer of said first elastomeric portion is in the range of 40–100, Shore A.

9. The shock absorber pad of claim 8 wherein said first elastomeric portion has a pyramidal configuration with a pair of integrally formed opposed arms for fastening said first elastomeric portion to said bottom surface.

10. The shock absorber pad of claim 7 wherein the durometer of said second elastomeric portion is in the range of 40–100, Shore A.

* * * * *